United States Patent [19]

Bosico et al.

[11] 4,019,294

[45] Apr. 26, 1977

[54] MARKER SUPPORT ARRANGEMENT

[75] Inventors: Joseph F. Bosico; David F. Bosico, both of Lansdale, Pa.

[73] Assignee: Bosico Precast Company, Lansdale, Pa.

[22] Filed: Nov. 4, 1975

[21] Appl. No.: 628,758

[52] U.S. Cl. ..... 52/103; 52/293

[51] Int. Cl.[2] ..... E04H 13/00

[58] Field of Search ..... 52/103, 293, 128–142

[56] References Cited

UNITED STATES PATENTS

| | | | |
|---|---|---|---|
| 861,470 | 7/1907 | Landon | 52/131 |
| 905,954 | 12/1908 | Thomas | 52/142 |
| 1,923,792 | 8/1933 | Neff | 52/137 |
| 2,046,204 | 6/1936 | Nickol | 52/131 |
| 2,150,778 | 3/1939 | Neff | 52/137 |
| 2,822,685 | 2/1958 | Chandler | 52/137 |
| 3,564,796 | 2/1971 | Smith | 52/131 |
| 3,772,826 | 11/1973 | Ferrer | 52/137 |

FOREIGN PATENTS OR APPLICATIONS

| | | | |
|---|---|---|---|
| 511,179 | 5/1952 | Belgium | 52/136 |
| 934,400 | 10/1946 | France | 52/423 |
| 812,960 | 7/1951 | Germany | 52/128 |
| 217,791 | 11/1941 | Switzerland | 52/103 |

*Primary Examiner*—Price C. Faw, Jr.

*Assistant Examiner*—Henry Raduazo

*Attorney, Agent, or Firm*—John W. Logan, Jr.

[57] ABSTRACT

The preferred embodiment of the invention disclosed herein relates to arrangements for supporting a marker such as a gravestone above an excavation such as a grave in which a receptacle member is buried. The saddle member is located in the excavation and has a support surface disposed above the receptacle member and below the ground surface surrounding the excavation. On the support surface is carried support means, for example, a plurality of blocks arranged in stacks to form a support base generally level with the ground surface around the excavation for supporting the marker. In one embodiment of the invention, the receptacle member is a vault in which a coffin is carried and the saddle is a generally U-shaped member having support legs seated on the top surface of the vault. In another embodiment of the invention, the receptacle member is a coffin and the saddle member comprises a lower U-shaped member supported in a trench in the bottom of the excavation below the coffin and also comprises an upper U-shaped member seated on the lower U-shaped member and providing the support surface.

1 Claim, 5 Drawing Figures

MARKER SUPPORT ARRANGEMENT

This invention relates to support arrangements and, more particularly, to support arrangements for supporting markers above a filled excavation.

In most instances when it is desired to support a marker above a filled excavation, a waiting period after the excavation has been filled is required before placing the marker. This waiting period is necessitated by the fact that after the excavation is filled, the fill dirt eventually settles changing the contour of the ground in the excavation area. Markers placed above the fill dirt before the settling period has terminated, sink and shift with the fill dirt.

Because of the waiting period a certain amount of extra expense is incurred in erecting a marker. Normally a support base is utilized to support the marker and after the fill dirt has settled, erection of the marker involves additional excavation to bury a support base in the ground. The additional excavation is somewhat costly as is other aspects of the erection procedure. In addition, if the marker is a gravestone to be erected on a grave site, the waiting period can be inconvenient for the bereaved family of the deceased. Usually the family would prefer to have the gravestone erected immediately after the burial.

An additional problem presented where the marker is a gravestone, can result if the receptacle member being buried is a coffin placed directly in the ground without a burial vault. Coffins are generally made of wood, which eventually deteriorates in the ground causing the ground above the coffin to settle. If the gravestone is supported on a support arrangement located in the ground above the coffin, it will settle with the ground necessitating not only filling of the ground, but also, a significant amount of work to straighten and support the gravestone.

It is noted that certain attempts have been made to solve the above problems by utilizing a precast, rigid support member which, in use, extends upwardly from the bottom of the excavation and terminates in a support base generally level with the ground surface around the excavation. While use of support members of the type described avoids the settling problems, it is not an entirely satisfactory solution. It is noted that the depth of the excavations, even grave sites, can vary considerably and thus, no standard size can be utilized for these support members. Significant expense results in either manufacturing and storing various sized support members or in attempting to vary the size of the excavation to accomodate the support member to be used.

Accordingly, it is an object of this invention to provide a support arrangement for markers above a filled excavation that does not require a waiting period from the time the excavation is filled until the marker is erected.

It is another object of this invention to provide a support arrangement for a marker above a filled excavation that is relatively inexpensive.

It is yet another object of this invention to provide a support arrangement for a marker above a filled excavation that can be readily adjusted to accommodate excavations of different depths.

Finally, it is an object of this invention to provide a support arrangement for a gravestone or the like above a grave site that is relatively inexpensive, that allows the gravestone to be erected at the time the grave site is filled, and that can be adjusted to accommodate the depth of the gravesite.

These and other objects of this invention are realized by providing a saddle member which is placed in an excavation with a receptacle to be buried therein. The saddle member includes a support surface located above the receptacle and below the ground surface surrounding the excavation. On the support surface is carried support means extending upwardly from the support surface and terminating in a support base generally level with the ground surface around the excavation for supporting the marker. The height of the support means can be varied to accommodate the depth of the excavation.

In accordance with one embodiment of the invention the receptacle is a vault made of a generally rigid material, for example, concrete, and the saddle member is supported on the top surface of the vault. In accordance with another embodiment of the invention, the receptacle is a coffin made of a relatively weak material, for example, wood, which is subject to deterioration and the saddle member includes a lower generally U-shaped member supported on the bottom of the excavation below the coffin and which supports an upper U-shaped member including the support surface. In both embodiments of the invention, the support means is preferably support blocks, for example, hollow concrete or cinder blocks arranged in stacks. By varying the number of blocks in the stacks, the location of the support base can be varied in accordance with the depth of the excavation.

For a better understanding of the invention, reference is made to the following description of several preferred embodiments thereof taken in conjunction with the figures of the accompanying drawing, in which.

Figure 1:
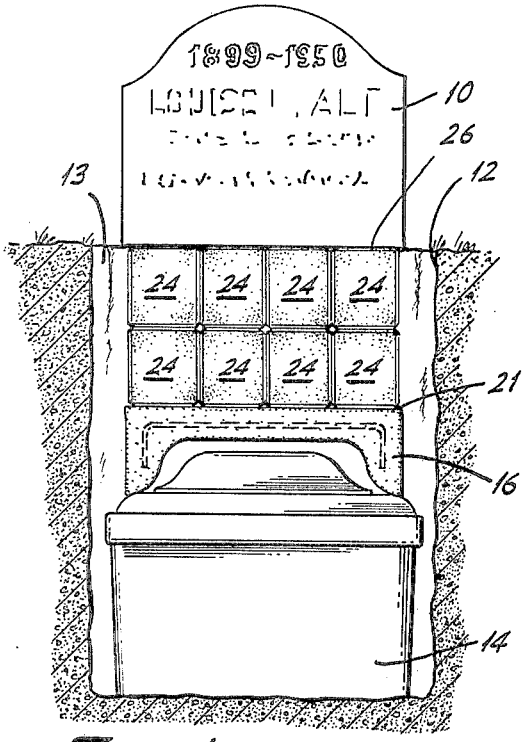
FIG. 1 is a partial sectional view illustrating a support arrangement for a gravestone in accordance with one embodiment of the invention.
Figure 2:
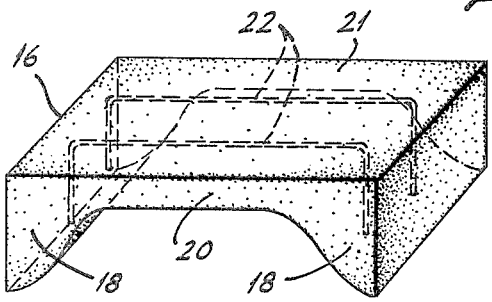
FIG. 2 is a perspective view of a saddle member usable in the embodiment of the invention illustrated in FIG. 1.

Referring now to FIGS. 1 and 2 of the drawing, there is illustrated a first embodiment of the invention supporting a marker such as a gravestone 10 above an excavation such as a grave 12 in which fill dirt 13 has been placed. In this embodiment of the invention, a receptacle to be buried in the ground is in the form of a burial vault 14 made of concrete, steel or similar types of rigid material not subject to rapid deterioration. The burial vault 14 is adapted to contain a coffin (not shown) in which the body of a deceased is contained.

As part of the arrangement for supporting the gravestone 10, there is provided a generally U-shaped saddle member 16 formed with a pair of generally parallel leg members 18, 18 connected by a transverse leg member 20. The top surface, as illustrated in the drawing, of the leg member 20 is generally flat and forms a support surface 21 and the free end of the leg member 18, 18 are generally curved and adapted to seat on the top surface of the vault 14. The saddle member 16 is preferably precast concrete or a similar rigid material and has a pair of generally U-shaped reinforcing rods 22, 22 embedded therein. The reinforcing rods extend through the leg members 18, 18 and the leg member 20. In use, the saddle member 16 seats on the top surface of the vault 14 so that the support surface 21 is located above the top surface of the vault 14 and below the ground surface surrounding the excavation 12. The thickness of the saddle member 16 is such that when placed on the vault 14 the saddle member extends along only a small portion of the length of the vault usually at one end, the head end thereof.

Located on top of the support surface 21 is support means including a support base generally level with the ground surface surrounding the excavation. In the preferred embodiment of the invention disclosed herein, the support means comprises a plurality of support blocks 24 arranged on top of each other in adjacent stacks and which extend upwardly from the support surface 21 of the saddle member 16. The top surface of the top row of support blocks 24 provides a support base 26 which is generally even with the ground surface around the excavation 12 and on which the gravestone 10 is supported. It is noted that by stacking the blocks 24, the location of the support base 26 relative to the ground surface around the excavation 12 can be varied to accomodate various excavation depths. In some instances, the support base 26 will be slightly above the ground surface or will be slightly below the ground surface depending on the depth of the excavation and the height of the individual blocks. By adding or removing some of the fill dirt 13, however the location of the support base 26 is appropriate to support the gravestone 10. The support blocks 24 are preferably masonry blocks such as hollow concrete blocks, cinder blocks or bricks or any suitable combination thereof. The support blocks 24 can be any other type of material which does not rapidly deteriorate in the ground and which is rigid enough to support the gravestone 10.

In use, after the excavation 12 has been dug and the vault 14 and coffin have been placed in the bottom of the excavation, the saddle member 16 is placed on top of the vault 14 at the head end thereof. Thereafter, the support blocks 24 are stacked on top of each other on the support surface 21 until the base portion 26 is generally level with the ground surface around the excavation. At this point, the grave 12 is filled with the fill dirt 13 as is generally conventional and then the gravestone 10 is placed on the support base 26. When the fill dirt 13 settles, the gravestone 10 remains in place being supported on the rigid vault, saddle and support blocks.

Figure 3:
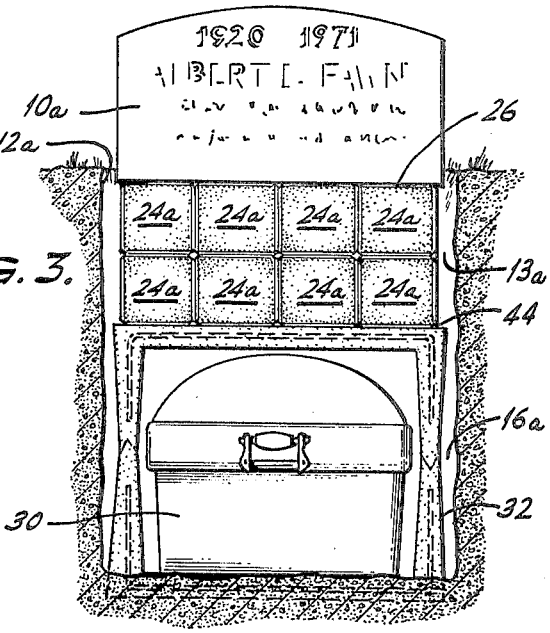
FIG. 3 is a partial sectional view illustrating a support arrangement for a gravestone in accordance with another embodiment of the invention.
Figure 5:
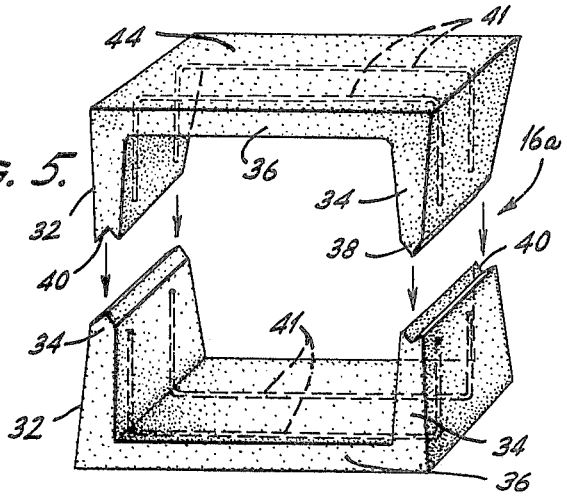
FIG. 5 is a perspective view of a saddle member usable in accordance with the embodiment of the invention illustrated in FIG. 3.
Figure 4:
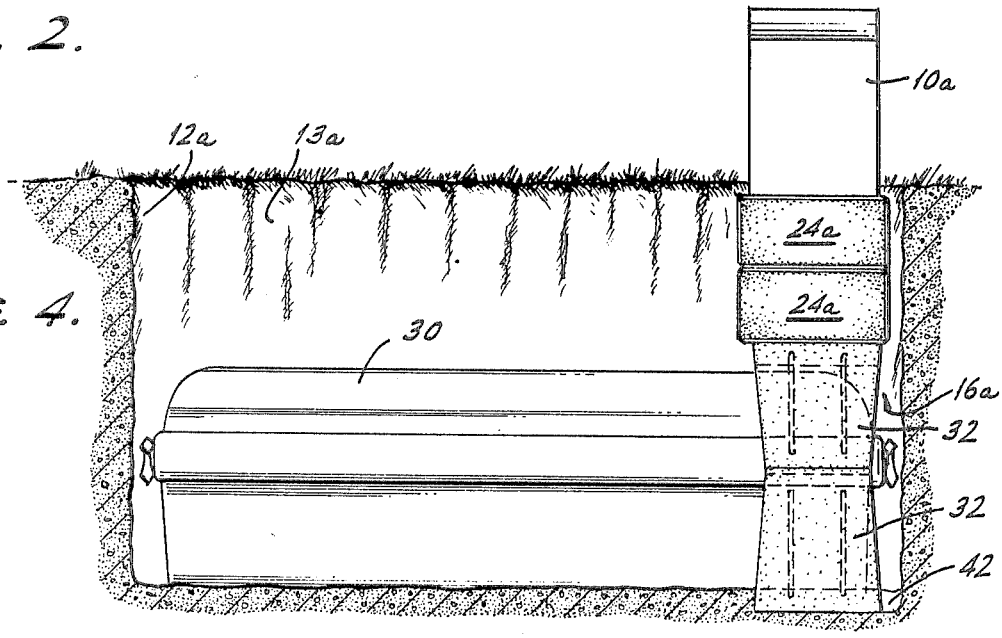
FIG. 4 is a partial sectional view of a support arrangement for a gravestone in accordance with the embodiment of the invention illustrated in FIG. 3 and taken generally along the line 4—4 thereof.

Referring to FIGS. 3 through 5 of the drawing, there is illustrated another embodiment of the invention which will be described using the same reference numerals used in FIGS. 1 and 2 except that the suffix *a* has been added. In this embodiment of the invention a marker such as a gravestone 10*a* is supported above an excavation such as a grave 12*a* in which fill dirt 13*a* has been placed. The receptacle to be buried is in the form of a coffin 30 which is generally made of wood covered with sheetmetal. Coffins of this type are subject to generally rapid deterioration in the ground with the passage of time and are not sufficiently rigid to support the saddle 16 disclosed in the FIGS. 1 and 2 embodiment of the invention. Accordingly, a saddle member 16*a* is utilized and is not supported on the coffin, but on the bottom of the grave. The saddle member 16*a* comprises a pair of generally identical U-shaped members 32, 32 arranged to provide a lower member seated on the bottom of the grave and an upper member extending above the coffin 30. Each member 32 includes a pair of generally parallel leg members 34, 34 and a connecting leg member 36. One of the leg members 34 is formed with a V-shaped projection 38 on its free end and the other is provided with a U-shaped groove 40. The outer surface of the leg members 36 are generally flat as seen in the drawing. Each of the members 32 has a pair of generally U-shaped reinforcing rods 41, 41 embedded therein. Because the members 32, 32 are identical their manufacture and use is facilitated.

In use, the leg member 36 of the lower of the generally U-shaped members 32 seats in a trench 42, as best seen in FIG. 4 of the drawing, located in the bottom of the grave 12 and at the head end thereof. The depth of the trench is such that the upper surface, as seen in the drawing, of leg member 38 is generally level with the bottom of the grave 12. The leg members 34, 34 of the lower generally U-shaped member extend upwardly along the sides of the coffin 30 and have seated thereon the leg members 34, 34 of the upper generally U-shaped member. The projections 38 are received in the grooves 40. The flat outer surface of the leg member 36 of the upper generally U-shaped member is located above the coffin 30 but below the ground surface around the grave 12 and provides a support surface 44.

Similar to the embodiment disclosed in FIGS. 1 and 2 of the drawing, support means is located on the support surface 44 and provides a support base 26*a* generally level with the ground surface around the excavation. The support means comprises a plurality of support blocks 24*a* similar to blocks 24 arranged on top of each other in stacks as also described with respect to blocks 24.

In use, the grave 12*a* is dug and the trench 42 is formed adjacent the head end of the coffin. One generally U-shaped member 32 is placed in the grave with the leg member 38 seated in the trench as described previously. The coffin 30 is then placed in the grave 12*a* resting on the bottom of the grave and on the top surface of the leg member 38. At this point, the other generally U-shaped member 32 is placed on the lower one of the members and the support blocks 24*a* are arranged in stacks on the support surface 44 until the support base 26*a* is provided generally level with the ground surface around the grave. The fill dirt 13*a* placed in the grave 12*a* and then the gravestone 10*a* is placed on the support base 26*a.*

With the support arrangement disclosed in FIGS. 3 through 5 of the drawing, all of the advantages disclosed with respect to FIGS. 1 and 2 embodiments are obtained. In addition, since the saddle is supported on the bottom of the excavation, deterioration of the coffin and the consequential settling of the ground above the coffin does not effect the support of the gravestone 10*a.* When the ground above the coffin settles, it can be filled, but the gravestone need not be relocated.

While in the foregoing, several embodiments of a preferred embodiment of the invention have been disclosed, it should be obvious to those skilled in the art that various changes and modifications can be made without departing from the true spirit and scope of the invention recited in the appended claims.

We claim:

1. A combination comprising a coffin, an excavation in which said coffin is located, said excavation including a trench formed in the bottom of and at one end thereof, said trench having a length significantly less than that of said excavation, a lower generally U-shaped saddle member including a first pair of generally parallel leg members connected at one end by a generally transverse leg member, said lower saddle member being located in said excavation with said transverse leg member being in said trench and below said coffin and with said generally parallel leg members extending upwardly along the sides of said coffin, said parallel leg members terminating in free end face located below the top surface of said coffin, one of said free end faces being formed with a projection and the other free end face being formed with a notch, an upper generally U-shaped saddle member including a second pair of generally parallel leg members connected at one end by a second generally transverse leg member having a generally flat surface, said second pair of generally parallel leg members extending from said second generally transverse leg member a distance equal to the distance which said first generally pair of parallel leg members extend from said first transverse leg member, said second pair of generally parallel leg members terminating in free end faces one of which is formed with a projection and the other of which is formed with a notch, said upper saddle member being located in excavation with the free end faces of said second pair of generally parallel leg members bearing on the free end faces of said first pair of generally parallel leg members with the said projection in one pair seating in said notch in the other pair and with said generally flat surface being located closely adjacent the top surface of said coffin and below the ground surface around said excavation, and support means on said generally flat surface extending upwardly therefrom and terminating in a support base generally level with the ground surface around said excavation for supporting a marker, said support means comprising a plurality of blocks placed on top of each other.

* * * * *